US005479796A

United States Patent [19]

Shimano

[11] Patent Number: 5,479,796

[45] Date of Patent: Jan. 2, 1996

[54] ORNAMENT WITH A COMPACT-DISC

[75] Inventor: Seiichi Shimano, Osaka, Japan

[73] Assignee: Nikkodo Co., Ltd., Osaka, Japan

[21] Appl. No.: 264,208

[22] Filed: Jun. 22, 1994

[30] Foreign Application Priority Data

Jun. 22, 1993 [JP] Japan ..... 5-033578 U

[51] Int. Cl.[6] ..... A44C 25/00

[52] U.S. Cl. ..... 63/2; 63/18; 63/23

[58] Field of Search ..... 63/18, 2, 29.1, 63/21, 22, 23; 403/290

[56] References Cited

U.S. PATENT DOCUMENTS

| | | | |
|---|---|---|---|
| 1,269,422 | 6/1918 | Gordon | 351/41 |
| 1,362,384 | 12/1920 | Benjamin et al. | 63/18 |
| 2,358,262 | 9/1944 | Suess | 63/18 |
| 3,678,705 | 7/1972 | Korwin | 63/18 |
| 3,898,870 | 8/1975 | Jacobson | 63/18 |
| 3,964,187 | 6/1976 | Stumpf | 63/18 |
| 4,091,639 | 5/1978 | Benda | 63/18 |
| 4,446,605 | 5/1984 | Molas | 24/20 LS |
| 4,765,154 | 8/1988 | Martin | 63/23 |
| 5,383,554 | 1/1995 | Cowan | 206/310 |

*Primary Examiner*—Michael J. Milano

*Attorney, Agent, or Firm*—Edwin E. Greigg; Ronald E. Greigg

[57] ABSTRACT

An ornament including a compact-disc which comprises a concave ring, a size controlling device for securing a cutout portion formed in a part of the concave ring so to hold the compact-disc, and a device for attaching a chain to the size controlling device for suspending the concave ring by the size controlling device.

2 Claims, 3 Drawing Sheets

ORNAMENT WITH A COMPACT-DISC

BACKGROUND OF THE INVENTION

The present invention relates to an ornament for displaying a compact-disc.

There have been a variety of ornaments which are used for a pendant or the like. Not only jewels or precious metals but also those small articles that are essentially used for other purposes such as coins are often used for an ornament by suspending them with chains or strands.

For ornamental purposes, those elements which glitter, such as jewels or precious metals, are preferably employed.

The compact-disc has been developed as a medium to record a mass of information, such as music or data, and has a layer which reflects light. Since the layer reflects light in various colorful ways, the compact disc looks very beautiful.

OBJECT OF THE INVENTION

It is an object of the present invention to provide a structure for utilizing a compact-disc as an ornament.

SUMMARY OF THE INVENTION

The present invention provides:

a ring having a concave section which catches a peripheral edge of a compact-disc;

means for controlling a diametrical size of the ring, and means for attaching chains or strands to the ring to suspend same.

The present invention might employ a plate which has a little larger size than a compact-disc, instead of said section-concave ring, and might further comprise:

means for retaining said compact-disc; and means for attaching chains or strands to said plate to suspend said plate.

In the present invention, a compact-disc is firmly caught in the concavity of said section-concave ring by narrowing the diameter of said section-concave ring with said size-controlling means. The section-concave ring with the compact-disc is used for an ornament by suspending with chains or strands.

When disengaging the compact-disc from the section-concave ring, the size-controlling means is released and the compact-disc is removed.

In using the plate which has a little larger size than a compact-disc, the compact-disc is held in place by a retention means formed in the plate. In this embodiment, the back side of the compact-disc is covered with the plate.

DETAILED DESCRIPTION OF THE PREFERRED EMBODIMENT

Following is a detailed description of an ornament for displaying a compact-disc referring to the present invention according to the drawings.

Figure 1:
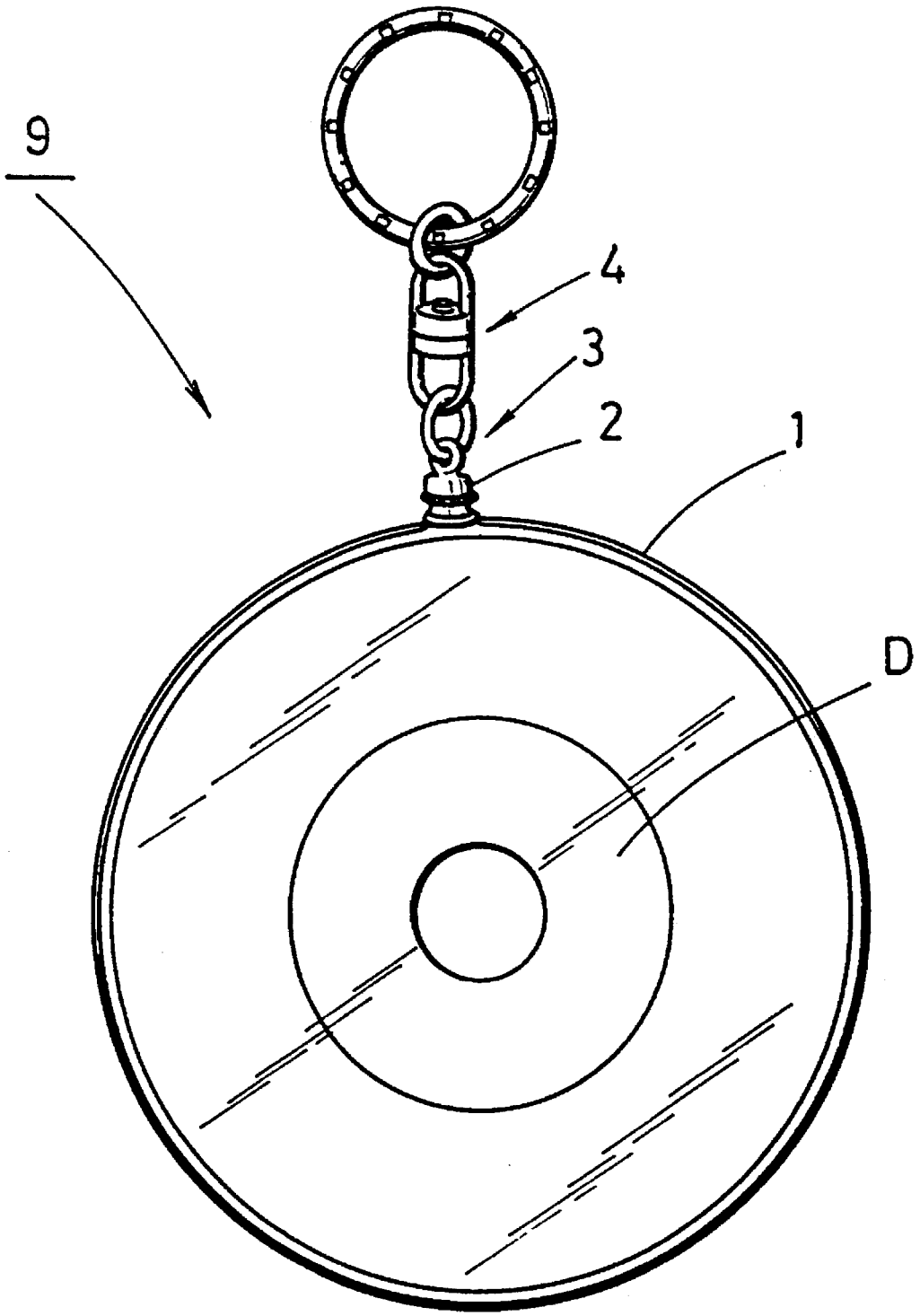
FIG. 1 is a general view of an embodiment of the present invention.
Figure 2:
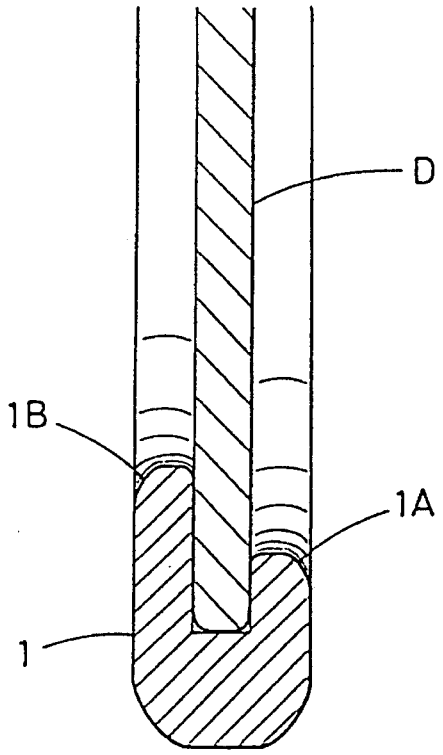
FIG. 2 is a partial section view of the embodiment.
Figure 3:
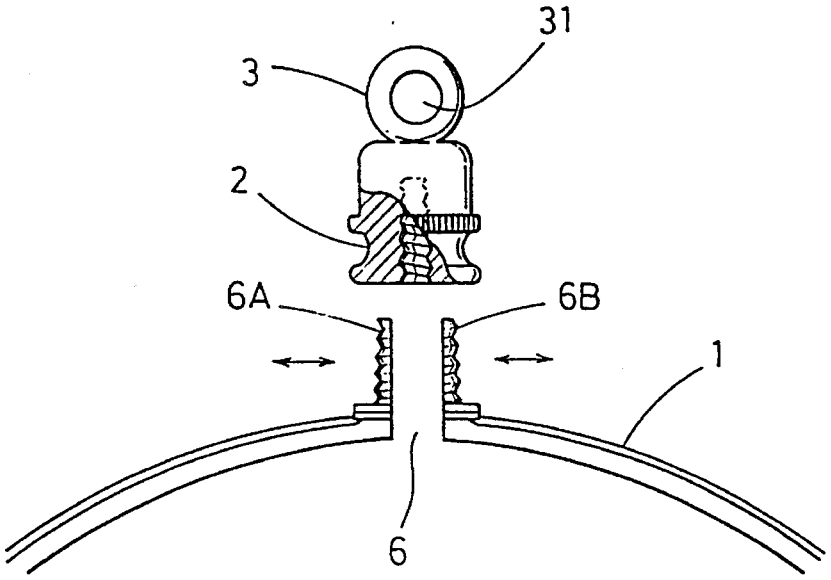
FIG. 3 is a partial section view of the embodiment.

In the drawings, FIGS. 1, 2 and 3, D is a compact-disc of 8cm diameter and 1 is a section of a concave ring which supports the compact-disc D in a groove or channel within the ring.

In FIGS. 1 and 3, 2 is a nut means for controlling a size of a diameter of the ring 1. A cutout portion 6 formed on the concave ring 1 has projecting portions 6A, 6B and outside screw threads are formed on the projecting portions 6A, 6B. Inside screw threads of the means 2 are engaged with the outside screw threads of the projecting portions 6A, 6B, and thereby the means 2 is connected to the cutout portion 6.

An attaching means 3 is integrally formed on the nut means 2 and a chain 4 is connected to the attaching means 3 through a bore 31 formed in the attaching means 3.

The diameter and the height of the edges of the channel in the concave ring 1 is different between a front side edge 1A and a back side edge 1B. This is best shown in FIG. 2. The front side edge 1A has a 1mm height which enables easy disengagement of a compact-disc while the back side edge 1B is higher than the front side edge 1A to avoid the disengagement.

To install the compact-disc D into the concave ring 1, the nut means 2 is detached from the projecting portions 6A, 6B and the projecting portions 6A, 6B are separated more than 7mm from each other. In so doing, the diameter of the concave ring 1 is enlarged about 2mm and the compact-disc D is inserted from the front side of the concave ring 1 and set in the concavity of the concave ring 1. After the compact-disc D is set, the nut means 2 is engaged again onto the outside screw threads of the projecting portions 6A, 6B to draw the projecting portions 6A, 6B closely to each other and retain them together. As the result, the diameter of the concave ring 1 is narrowed and the detachment of the compact disc D is avoided.

In this way, the concavity of the concave ring 1 holds the peripheral edge of the compact-disc D. The concave ring 1 with the compact-disc D can then be used for an ornament like a pendant by suspending it from a chain supported through the bore 31. The concave ring 1 with the compact-disc D may be used as a key holder or as an interior design element.

Figure 4:
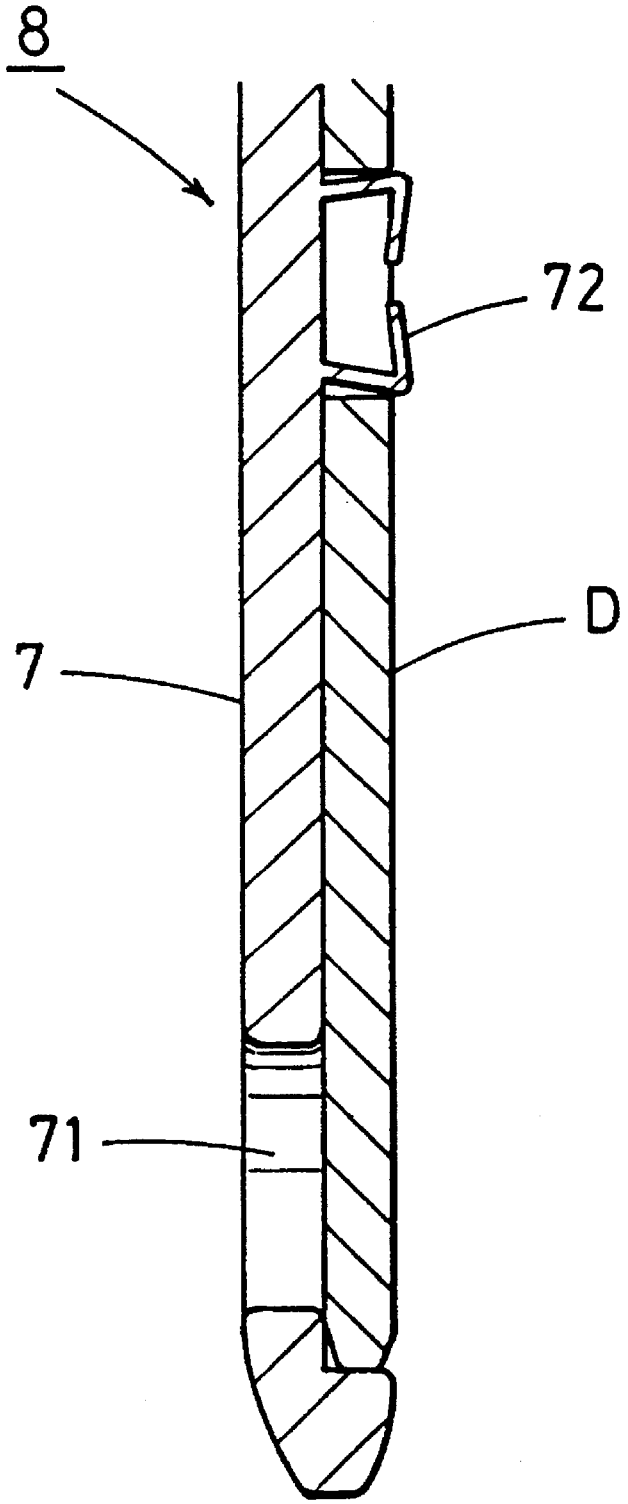
FIG. 4 is a partial section view of another embodiment.

In this first embodiment, it is preferable to cover the back side of the compact-disc with a transparent cover. FIG. 4 shows another embodiment referring to another type of ornament 8. In this embodiment, the back side of the compact-disc D forms a back side supporting body 7. It is preferable that the back side supporting covering 7 is transparent. An aperture 71 is formed in the backside of the supporting body 7 to allow one to insert a finger and push the compact-disc D from the back side out of the support body or plate 7.

In the middle of the supporting body, an elastic engaging means 72 is formed to partially cover a central hole of the compact-disc D. In this embodiment it is unnecessary to provide a groove or channel to hold the compact-disc D at the periphery of the compact disc as was done in the first embodiment.

In the above embodiments, an attaching means is integrally formed on a size-controlling means but the attaching means may be separated from the size-controlling means and formed onto the concave ring directly.

In the above embodiments, a chain can be substituted by a strand of rope or the like. It may be desirable to prepare various colors of chains or strands.

If one always has such an ornament with their favorite compact-disc as a pendant, one can listen to the compact-disc any time they want by simply setting the compact-disc in a CD player. As is well known, one does not have to worry about flaws on a surface of the compact-disc because they do not damage easily. However, it is preferable to cover the front side of the compact-disc with a transparent cover.

The ornament with a compact-disc in the present invention can always be carried or it is possible to give to somebody for a present.

The foregoing relates to a preferred exemplary embodiment of the invention, it being understood that other variants and embodiments thereof are possible within the spirit and scope of the invention, the latter being defined by the appended claims.

What is claimed:

1. An ornament including a compact-disc consisting of:

a supporting body having a closed back-side which has a size larger than the compact-disc;

means in a center of said closed back-side for retaining the compact disc on said supporting body;

an aperture in said closed back-side by which said compact disc can be forced from said ornament; and means for attaching a chain or a strand to said supporting body to suspend said supporting body.

2. An ornament consisting of:

a ring having a concave groove along an inner surface of said ring;

said ring having a diametrical cut-out portion;

oppositely disposed projections extending from said cut-out portion along an extended radial line;

each of said projections including threads thereon which when pressed together forms a continuous thread, and decreases the inner diameter of said ring;

nut means having threads along a inner surface which match said threads on said threaded projections;

said nut means including a ring-shaped means to which means can be attached for securing said ornament for displaying a compact-disc;

a compact-disc held within said ring;

at least one transparent cover provided covering a side of said compact-disc to enclose same; and said nut means, when screw threaded onto said projections, decreases an inner diameter of said ring to secure said compact-disc within said concave groove of said ring.

* * * * *